US007291029B2

(12) United States Patent
Hale et al.

(10) Patent No.: US 7,291,029 B2
(45) Date of Patent: Nov. 6, 2007

(54) T-8 TO T-5 ADAPTER LAMPHOLDER

(75) Inventors: Scot J. Hale, Williston Park, NY (US); Anthony Tufano, North Massapequa, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 11/379,150

(22) Filed: Apr. 18, 2006

(65) Prior Publication Data

US 2006/0286841 A1 Dec. 21, 2006

Related U.S. Application Data

(60) Provisional application No. 60/672,616, filed on Apr. 18, 2005.

(51) Int. Cl.
*H01R 13/02* (2006.01)

(52) U.S. Cl. ..... 439/236; 439/356; 439/226

(58) Field of Classification Search ..... 439/236, 439/230, 271, 242, 280, 617, 682, 238, 226, 439/365, 356, 233–234, 240; 362/217, 376, 362/396, 269, 226, 448, 441
See application file for complete search history.

(56) References Cited

U.S. PATENT DOCUMENTS

| | | | | |
|---|---|---|---|---|
| 2,483,165 | A | 9/1949 | Young | |
| 3,305,823 | A | 2/1967 | Dahihaus | |
| 4,280,169 | A * | 7/1981 | Allen | 362/217 |
| 5,904,415 | A | 5/1999 | Robertson et al. | |
| 6,641,419 | B1 * | 11/2003 | Richardson | 439/230 |
| 6,890,199 | B2 * | 5/2005 | Vogt et al. | 439/238 |
| 2005/0202704 | A1 * | 9/2005 | Lingemann et al. | 439/236 |

* cited by examiner

*Primary Examiner*—Truc T. Nguyen
*Assistant Examiner*—Edwin A. Leon
(74) *Attorney, Agent, or Firm*—Paul J. Sutton

(57) ABSTRACT

An adapter for fluorescent lamp fixtures that retrofits a T-8 lamp fixture for a T-5 fluorescent lamp that is simple and inexpensive is disclosed herein. The lampholder adapter includes a rotatable locking disk member set in a base assembly for receiving the end-prongs of a fluorescent lamp. The lampholders adapters of at least two different lengths, placed at either end of the fixture may be a T-5 fluorescent lamp of variable lengths. These lampholder adapters are connected to retrofit existing T-8 fixtures, allowing the use of T5 lamps by compensating for the lamp length difference and, thereby, saving the manufacturers substantial money in retooling costs.

18 Claims, 5 Drawing Sheets

T-8 TO T-5 ADAPTER LAMPHOLDER

This application claims the benefit of the filing date of a provisional application having Ser. No. 60/672,616 which was filed on Apr. 18, 2005.

FIELD OF THE INVENTION

The present invention relates to an adapter for lamps.

BACKGROUND

Standard ceiling lamp fixtures for use with fluorescent lamps are ordinarily modular in design and fit into standard ceiling modular fixtures. Many such fixtures are designed to accept 4-foot long fluorescent lamps, typically operating at 40 watts each. Fluorescent light fixtures most commonly employ tubular fluorescent lamps. Most common of these is the T-8 fluorescent lamp. The T-8 fluorescent lamp typically is available in several nominal lengths of 48 inches, 36 inches and 24 inches. There are numerous choices of fluorescent light fixtures. These modular ceiling fixtures are as short as the 4-foot lamps they are designed to accept.

Recently introduced into the American market place, the T-5 fluorescent lamp provides a more energy efficient fluorescent lamp than that of the T-8 fluorescent lamp. The T-5 fluorescent lamp is now being adopted by light fixture manufacturers. The T-5 fluorescent lamps have metric dimensions with nominal lengths of 1149 mm (45.24 in.), 849 mm (33.43 in.), and 549 mm (21.61 in.) all of which are substantially smaller than the nominal lengths of the T-8 fluorescent lamp. In addition, the T-5 lamps exhibit favorable energy efficiencies. These features and other desirable characteristics, make the T-5 fluorescent lamp an attractive option for light engineers who may consider retrofitting the conventional T-8 fluorescent fixtures. A retrofit would enable the use of the same conventional T-8 fluorescent fixture with the new T-5 fluorescent lamp. Since retrofitting the conventional T-8 fluorescent fixtures is a reasonable solution, cost conscious fixture manufacturers are continuing to produce the conventional T-8 light fixtures to enable use of these same fixtures for T-5 fluorescent lamps.

These T-8 light fixtures, however, were originally and optimally designed for use with T-8 imperial fluorescent lamps only. The various lengths of the T-5 fluorescent lamp are considerably shorter than the lengths of the standard T-8 lamp sizes as noted above. Thus, the existing T-8 lamp mounting hardware of conventional fluorescent fixtures is not practical for mounting of T-5 lamps when considering only the respective lengths of the lamp.

Concerning the electrical adaptability, existing T-8 lamp fixtures can be retrofitted to be more energy efficient, enabling T-5 lamps to be placed in these fixtures. Since fluorescent light fixtures designed for use with T-8 lamps are optimized in view of the characteristics of the T-8 lamp, a retrofit must necessarily provide the best possible photometric performance for T-5 lamps in light of that which is conventionally provided for T-8 lamps. In addition, there is a need for a retrofit that accommodates differing lengths of the T-5 or similar lamps. This retrofit must have a minimum number of physical parts devoted to this purpose. These parts must be inventoried in advance of actual assembly to conventional T-8 fixtures.

Thus, a need exists for an adapter for fluorescent lamp fixtures that retrofit a T-8 lamp fixture for a T-5 fluorescent lamp that is simple and inexpensive.

The present invention is directed to overcoming, or at least reducing the effects of one or more of the problems set forth above.

SUMMARY OF THE INVENTION

To address the above-discussed deficiencies of the conventional T-8 lamp fixture, the present invention provides a lampholder adapter for retrofitting a conventional T-8 lamp fixture so that such fixture can accommodate T-5 fluorescent lamps of any size. The adapter structure of the present invention permits fluorescent tubes of differing wattage and shorter length to be installed in the a light fixture originally configured for use with fluorescent tubes of greater wattage and longer length. Thus, these novel lampholder adapters "adapt" existing T-8, fixtures by compensating for the lamp length difference between the T-8 and T-5 fluorescent lamps and, thereby, saving the manufacturers substantial money in retooling costs.

The lampholder adapter includes a rotatable locking disk member set in a base assembly for receiving the end-prongs of a fluorescent lamp. A fluorescent lamp may be installed in the lampholder adapter by having the end-prongs on either end of the fluorescent lamp pass through a first slot in the base assembly that aligns with the locking disk member. The fluorescent lamp seated in the locking disk member may be rotated such that the end-prongs of the fluorescent lamp are locked in the locking disk member. In sum, the lampholder adapter of the present invention has a base assembly having a main portion with an aperture and a first slot; a disk having a second slot is rotatably mounted within the main portion whereby the disk has a first position in which the first slot is aligned to the second slot and a second position where the slots are not aligned to each other so as to preventing insertion of any portion of a lamp within the slots.

In addition, the lampholders are constructed with built-in flexibility such that they can be bent outward to accommodate a slightly larger lamp. This is done by adding a gap in the lampholder body behind the main portion of the body. In addition, there is a member which is parallel to the main body, behind the gap which is used to brace the lampholder against the fixture. This allows the main body of the lampholder to flex outward while ensuring that the entire lampholder does not rotate out of position with respect to the fixture.

The lampholder adapter, having at least two different lengths, slides in place at either end of the fixture. Depending upon the length of the T-5 fluorescent lamp, the size of lampholder adapter is selected appropriately to compensate for the lamp length difference between a standard T-8 fluorescent lamp and the T-5 fluorescent lamp. These lampholder adapters are connected to retrofit conventional T-8 lamp fixtures, allowing the use of T5 lamps by compensating for the lamp length difference and, thereby, saving the manufacturers substantial money in retooling costs.

Advantages of this design include but are not limited to an adapter for fluorescent lamp fixtures that retrofit a T-8 lamp fixture for a T-5 fluorescent lamp that is simple and inexpensive having a high performance, simple, and cost effective design.

These and other features and advantages of the present invention will be understood upon consideration of the following detailed description of the invention and the accompanying drawings.

BRIEF DESCRIPTION OF THE DRAWINGS

For a more complete understanding of the present invention and the advantages thereof reference is now made to the following description taken in conjunction with the accompanying drawings in which like reference numbers indicate like features and wherein.

DETAILED DESCRIPTION

The present invention will now be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
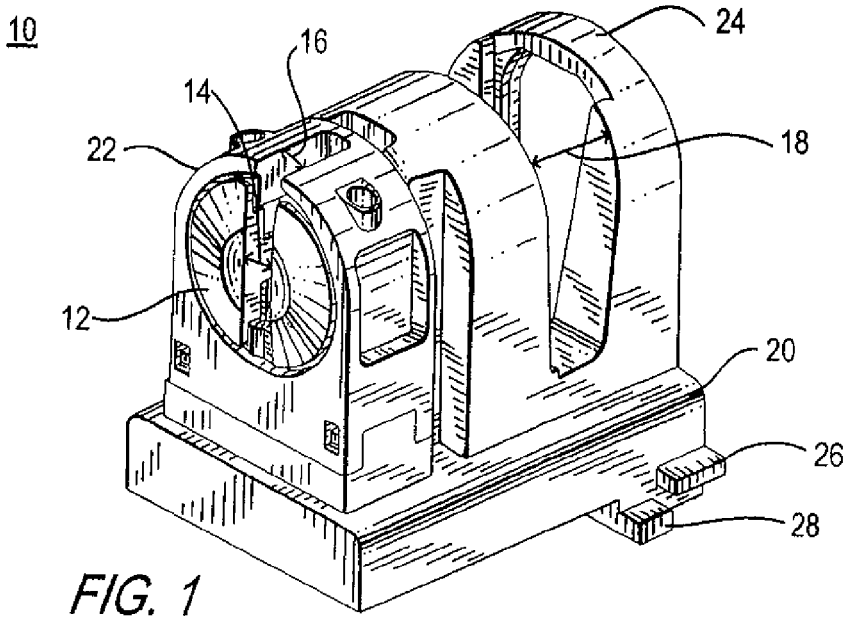
FIG. 1 illustrates a long lampholder adapter in accordance with the present invention.

Referring to FIG. 1, a long lampholder adapter 10 in accordance with the present invention is shown. A base assembly 20 includes a main body portion 22 that holds a rotatable locking disk member 12 having an aperture 14 for holding the end-prongs of a fluorescent lamp (not shown). A first slot 16 in the base assembly 20 enables the end-prongs of the fluorescent lamp to slide into the aperture 14 of the locking disk 12. The lampholder adapter 10 is constructed with built-in flexibility such that the adapter 10 can be bent outward to accommodate a slightly larger lamp; this is done by adding a second slot 18 in the lampholder base assembly 20 behind the main portion 22 of the base assembly 20. In addition, there is a member 24 which is parallel to the main portion 22, behind the second slot 18 which is used to brace the lampholder adapter 10 against the fixture (not shown). This allows the main body 22 of the lampholder adapter 10 to flex outward while ensuring that the entire lampholder adapter 10 does not rotate out of position with respect to the fixture. In sum, the lampholder adapter of the present invention comprises a base assembly having a main portion with an aperture and a first slot; a disk having a second slot is rotatably mounted within the main portion whereby the disk has a first position in which the first slot is aligned to the second slot and a second position where the slots are not aligned to each other so as to preventing insertion of any portion of a lamp within the slots.

Installation of a fluorescent lamp includes the insertion of the end-prongs of a fluorescent lamp (not shown) through the first slot 16 into the aperture 14 of the locking disk 12. Locking disk 12 may be rotated such that the first slot 16 of the base assembly no longer aligns with the aperture 14 of the locking disk 12. In this locking position, the end-prongs of the fluorescent lamp are locked within the locking disk 12. Thus, there are two positions in which the locking disk is stabilized: an aligned position and a locking position. In the aligned position, the first slot 16 of the base assembly aligns with the aperture 14 of the locking disk 12 enabling the end-prongs of a fluorescent lamp to pass through and be seated in the locking disk member. When the locking disk 12 is rotated, an audible click occurs when the disk has arrived at either the locking position or the aligned position, giving effective notice to the installer.

Sliding extensions 26 and 28 of the base assembly 20 are adapted to enable the lampholder adapter 10 to slide onto a variety of T-8 lamp fixtures including 18 GA and 22 thru 25 GA. Thus, there is no need for a spring loaded device. As shown, the lampholder adapter in accordance with the present invention includes a non spring loaded semi-flexible bracket. The re-lamping force is no longer at the front of the fixture. In this unique design the re-lamping force is transferred to back panel of fixture. The design includes a panel edge guard to protect the device from wire abrasion. The lampholder adapter may be shunted and non-shunted. As will be illustrated, these lampholder adapters may be used together or in combination. The lampholder adapter in accordance with the present invention "adapts" existing T-8 fixtures, allowing the use of T5 lamps by compensating for the lamp length difference thereby saving the manufacturers substantial money in retooling costs. In particular, a short adapter and a long adapter may be used at either end of the T-8 fixture. Another assembly may include a first and second short adapter placed at either ends of the T-8 fixture. In yet another assembly, a first and second long adapter may be placed at either end of the T-8 fixture. These arrangements are described in detail hereinafter.

Figure 2:
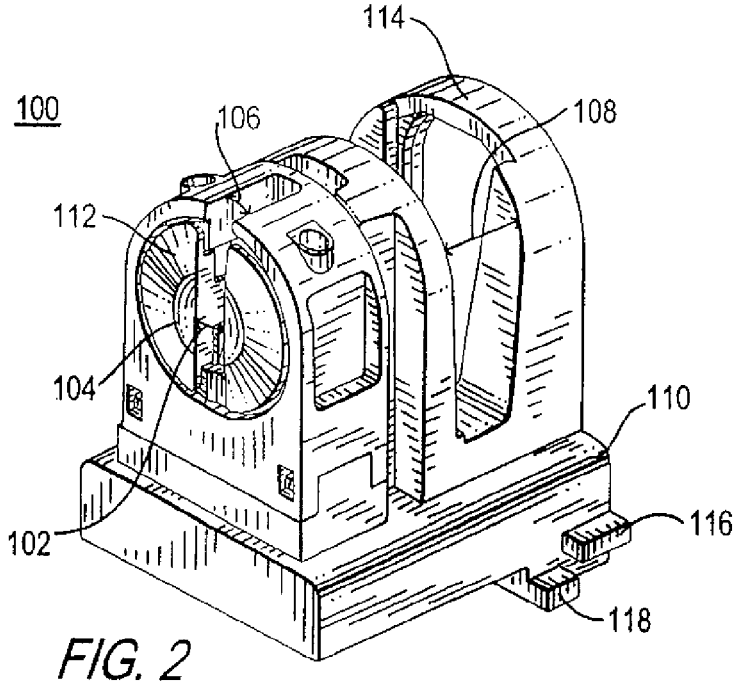
FIG. 2 displays a short lampholder adapter in accordance with the present invention.

Referring to FIG. 2, a short lampholder adapter in accordance with the present invention is shown. This lampholder adapter differs from adapter 10 in dimension only. As shown lampholder adapter 100 includes a base assembly 110 includes a main body portion 112 that holds a rotatable locking disk member 104 having an aperture 102 for holding the end-prongs of a fluorescent lamp (not shown). A first slot 106 in the base assembly 110 enables the end-prongs of the fluorescent lamp to slide into (or out of) the aperture 102 of the locking disk 104. The lampholder adapter 100 is constructed with built-in flexibility such that the adapter 100 can be bent outward to accommodate a slightly larger lamp. This is done by adding a second slot 108 in the lampholder base assembly 110 behind the main portion 112 of the base assembly 110. In addition, there is a member 114 which is parallel to the main body 112, behind the second slot 108 which is used to brace the lampholder adapter 100 against the fixture (not shown). This allows the main body 112 of the lampholder adapter 100 to flex outward while ensuring that the entire lampholder adapter 100 does not rotate out of position with respect to the fixture.

Installation of a fluorescent lamp includes the insertion of the end-prongs of a fluorescent lamp (not shown) through the first slot 106 into the aperture 102 of the locking disk 104. Locking disk 104 may be rotated such that the first slot 106 of the base assembly no longer aligns with the aperture 102 of the locking disk 104. In this locking position, the end-prongs of the fluorescent lamp are locked within the locking disk 104. Thus, there are two positions in which the locking disk is stabilized: an aligned position and a locking position. In the aligned position, the first slot 106 of the base assembly aligns with the aperture 102 of the locking disk 104 enabling the end-prongs of a fluorescent lamp to pass through and be seated in the locking disk member. When the locking disk 104 is rotated, an audible click occurs when the disk has arrived at either the locking position or the aligned position, giving effective notice to the installer.

Sliding extensions 116 and 118 of the base assembly 110 are adapted to enable the lampholder adapter 100 to slide onto a variety of T-8 lamp fixtures including 18 GA and 22 thru 25 GA.

Figure 3:
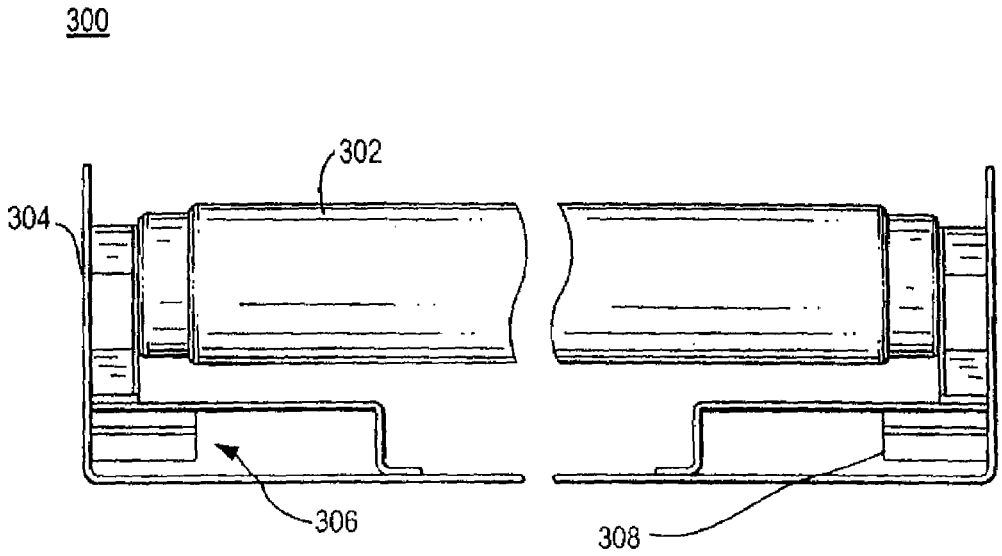
FIG. 3 (PRIOR ART)
FIG. 3 shows a side view of a known T-8 fluorescent lamp assembled in a known T-8 light fixture.

FIG. 3 represents a known T-8 lamp connected to the known T-8 fixture. As shown, fluorescent lamp 302 attaches to lamp fixture 304 at each end, 306 and 308. The following table illustrates the parameters used to determine key dimensions for new lampholders.

Difference between T8 & T5 Lamp Length (Pin to Pin Dimension)

| Nominal Length | T-8 | T-5 | Length Difference |
|---|---|---|---|
| (2 ft.) 24 in. | 23.73 | 22.17 | 1.56 |
| (3 ft.) 36 in. | 35.73 | 33.98 | 1.75 |
| (4 ft.) 48 in. | 47.73 | 45.80 | 1.93 |

As shown in the table above, there are three length for each fluorescent lamp type, T-8 and T-5, respectively. The table shows the differences between the lengths. The second table below presents the different combinations of lampholder adapters for each different lamp length application.

Application Lampholder Selection

| Nominal Length | Short | Long |
|---|---|---|
| (2 ft.) 24 in. | 2 | 0 |
| (3 ft.) 36 in. | 1 | 1 |
| (4 ft.) 48 in. | 0 | 2 |

As outlined in the table above, when a T-5 fluorescent lamp having a length of 2 ft. (24 in.) is installed in a T-8 fixture, two 'short' lampholder adapters are used to retrofit the T-8 fixture. To install a T-5 fluorescent lamp having a length of 3 ft. (36 in.) in a T-8 fixture, a 'long' and a 'short' lampholder adapter are used to retrofit the T-8 fixture. Finally, when installing a T-5 fluorescent lamp having a length of 4 ft. (48 in.), two 'long' lampholder adapters are used.

Figure 4:
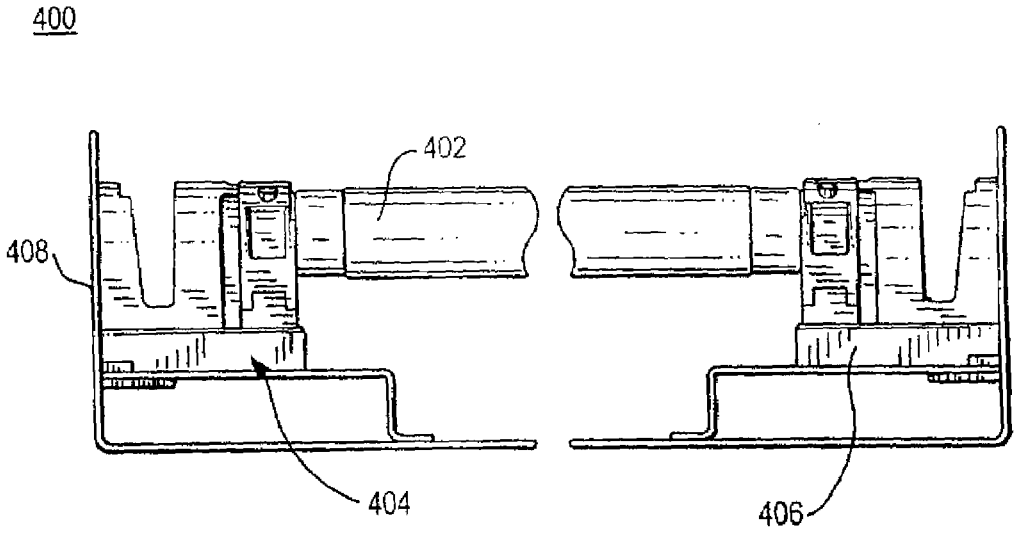
FIG. 4 shows a side view of a 4 ft (48 in.) T-5 fluorescent lamp assembled in a known T-8 light fixture, having two short lampholder adapters of the present invention attached to each end of the fixture.

FIG. 4 represents a lampholder assembly having a 4 foot (48 in.) T-5 lamp inserted in the T-8 fixture using two 'long' lampholder adapters, 404 and 406. The long T-5 lamp is approximately 45.24 inches in length. Thus, the difference between the T-8 fixture length and the short T-5 lamp must be supplemented augmented with two 'long' lampholder adapters at either end of the T-8 fixture.

Figure 5:
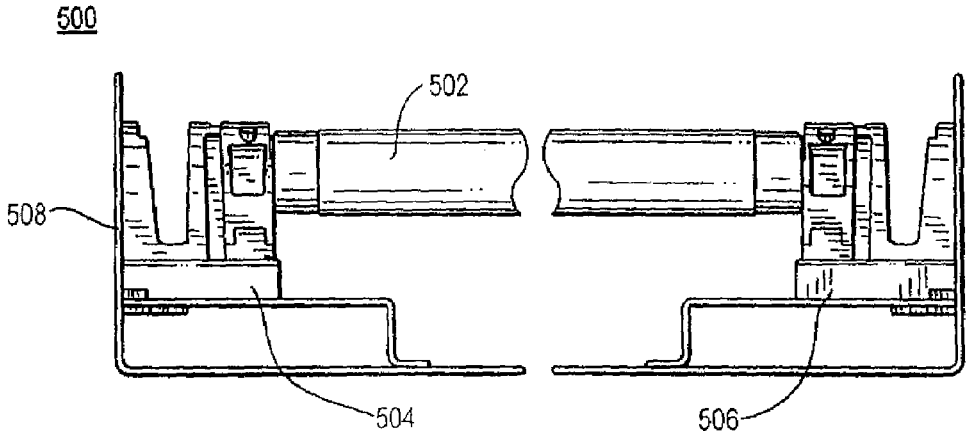
FIG. 5 shows a 2 ft (24 in.) T-5 fluorescent lamp assembled in a known T-8 light fixture, having two long lampholder adapters of the present invention attached to each end of the fixture.

FIG. 5 represents a lampholder assembly of 2 ft. (24 in.) having the T-5 lamp inserted in the T-8 fixture using two 'short' lampholder adapters, 504 and 506. The short T-5 lamp is approximately 21.61 inches in length. Thus, the difference between the T-8 fixture length and the short T-5 lamp must be supplemented augmented with two 'short' lampholder adapters at either end of the T-8 fixture.

Figure 6:
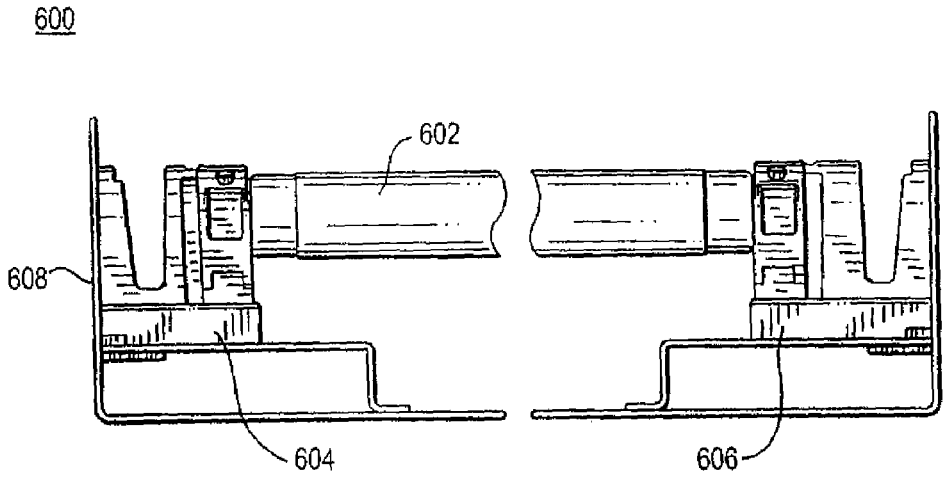
FIG. 6 shows a 3 ft (36 in.) T-5 fluorescent lamp assembled in a known T-8 light fixture, having a short and a long lampholder adapter of the present invention attached to each end of the fixture.

FIG. 6 represents a lampholder assembly of 3 ft. (36 in.) having the T-5 lamp inserted in the T-8 fixture using a 'long' and a 'short' lampholder adapter, 604 and 606, respectively. The short T-5 lamp is approximately 33.42 inches in length. Thus, the difference between the T-8 fixture length and the short T-5 lamp must be supplemented augmented with a 'long' and a 'short' lampholder adapter, 604 and 606, respectively, at either end of the T-8 fixture.

Figure 7D:
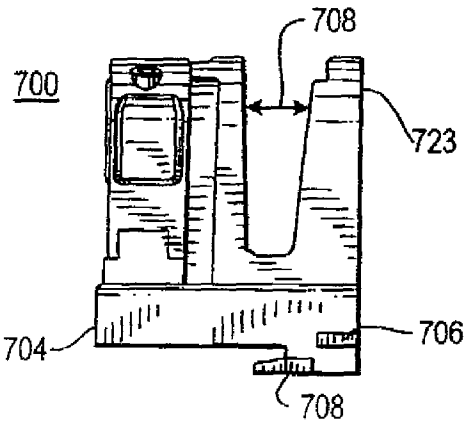
FIG. 7D shows a side view of the short lampholder adapter of the present invention.
Figure 7B:
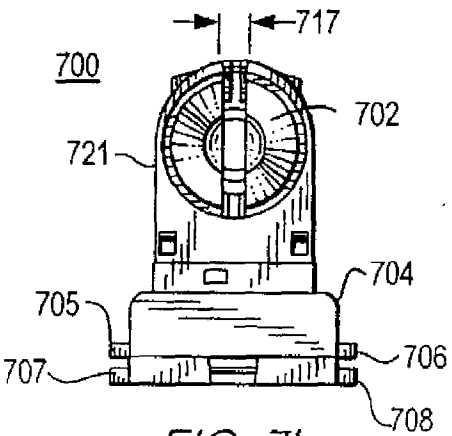
FIG. 7B shows a front view of the short lampholder adapter of the present invention.
Figure 7C:
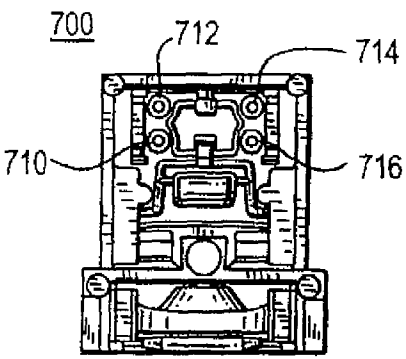
FIG. 7C shows a bottom view of the short lampholder adapter of the present invention.
Figure 7A:
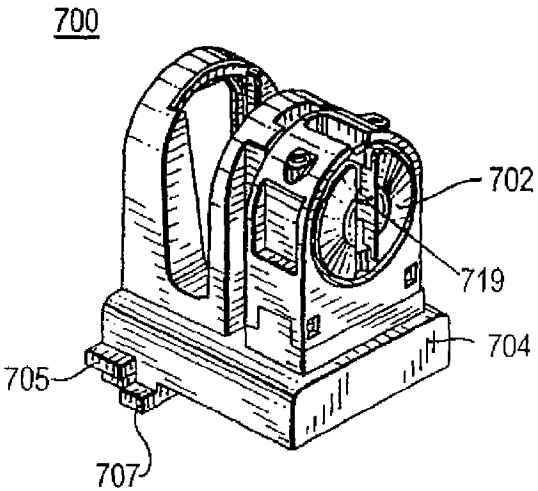
FIG. 7A shows a perspective view of the short lampholder adapter of the present invention.

FIGS. 7A-D depict the short lampholder adapter in a perspective view, a front view, a bottom view and a side view, respectively. Specifically, FIG. 7A represents the perspective view of the short lampholder adapter. FIG. 7B represents the front view wherein the end-prongs of a T-5 lamp are passed through the slot in the base assembly to rest in the slot of the locking disk. The locking disk 702 may be rotated such that the slot of the base assembly no longer aligns with the slot of the locking disk, such that the end-prongs of the T-5 lamp is locked within the locking disk. The locking disk clicks when the T-5 lamp is locked in the locking position. FIG. 7C shows the bottom surface of the lampholder adapter. Apertures 710, 712, 714 and 716 are provided for connection to four wires of the existing T-8 fixture. FIG. 7D displays the side view of the lampholder adapter. Sliding extensions 705, 707, 706 and 708 of the base assembly 704 are adapted to enable the lampholder adapter 700 to slide onto a variety of T-8 lamp fixtures including 18 GA and 22 thru 25 GA. A first slot 717 in the base assembly 704 enables the end-prongs of the fluorescent lamp to slide into the aperture 719 of the locking disk 702. The lampholder adapter 700 is constructed with built-in flexibility such that the adapter 700 can be bent outward to accommodate a slightly larger lamp; this is done by adding a second slot 708 in the lampholder base assembly 704 behind the main portion 721 of the base assembly 704. In addition, there is a member 723 which is parallel to the main body 22, behind the second slot 18 which is used to brace the lampholder adapter 10 against the fixture (not shown).

Figure 8D:
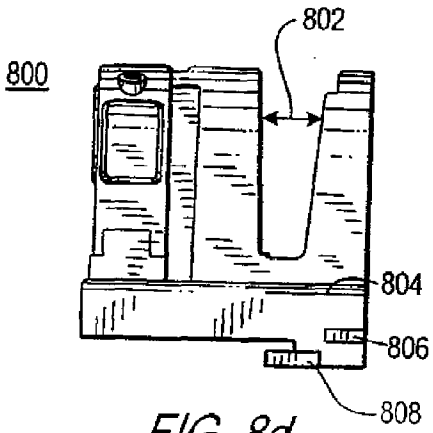
FIG. 8D shows a side view of the long lampholder adapter of the present invention.
Figure 8B:
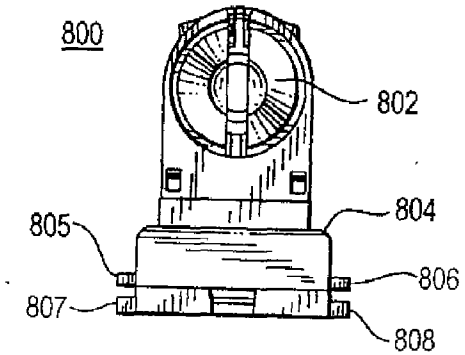
FIG. 8B shows a front view of the long lampholder adapter of the present invention.
Figure 8C:
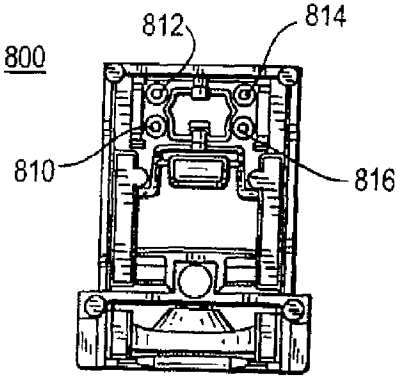
FIG. 8C shows a bottom view of the long lampholder adapter of the present invention.
Figure 8A:
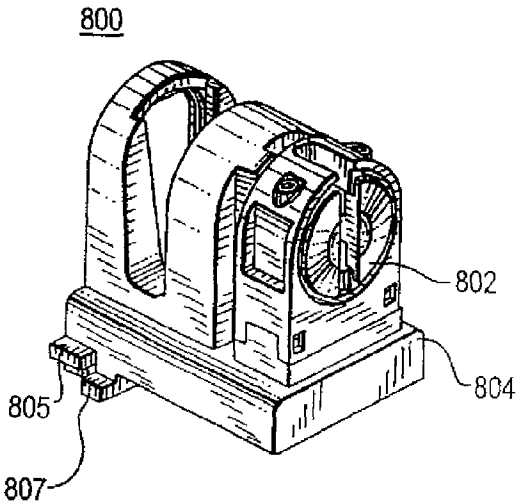
FIG. 8A shows an isometric view of the long lampholder adapter of the present invention.

FIGS. 8A-D illustrate the long lampholder adapter in an isometric view, a front view, a bottom view and a side view, respectively. Specifically, FIG. 8A represents the perspective view of the short lampholder adapter. FIG. 8B represents the front view wherein the end-prongs of a T-5 lamp is placed to sit inside pass the slot in the base assembly and in the slot of the locking disk. The locking disk may be rotated such that the slot of the base assembly no longer aligns with the slot of the locking disk, such that the end-prongs of the T-5 lamp is locked within the locking disk. The locking disk clicks when the T-5 lamp is locked in the locking position. FIG. 8C illustrates the bottom surface of the lampholder adapter. Apertures 810-816 are provided for connection to the wiring of the existing T-8 fixture. FIG. 8D displays the side view of the lampholder adapter.

Those of skill in the art will recognize that the physical location of the elements illustrated in FIGS. 1 and 2 can be moved or relocated while retaining the function described above. For example, the dimensions, location and shape of the base assembly may be altered.

Advantages of this design include but are not limited to an adapter for fluorescent lamp fixtures that retrofit a T-8 lamp fixture for a T-5 fluorescent lamp that is simple and inexpensive having a high performance, simple, and cost effective design.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A lampholder adapter for converting a T-8 lamp fixture to receive a T-5 fluorescent lamp, the lampholder adapter comprising:

a base assembly having a main body flexibly coupled to a base member and a brace member coupled to the base member behind the main body and spaced from the main body to provide a slot;

the main body portion having a first slot and at least one conductive lead aligned with an aperture;

a rotatable locking disk member, having a second slot, the rotatable locking disk member seated in the aperture of the main body portion, the first slot in the main body portion aligns with the second slot to enable the end-prongs of the lamp to slide into the rotatable locking disk member such that when the rotatable locking disk member is rotated, the end-prongs are locked in the rotatable locking disk member and the end-prongs make contact with the at least one conductive lead;

the base assembly having a non-spring loaded flexible slide on bracket for coupling the lampholder adapter to an end of said fixture;

wherein the main body can be bent into the slot toward the brace member to compensate for a fluorescent lamp length difference when re-lamping; and the brace member is adapted to contact the lamp fixture to brace the base assembly against the lamp fixture when re-lamping.

2. A lampholder adapter as recited in claim 1, wherein the base assembly is made of a non-conductive material.

3. A lampholder adapter as recited in claim 1, wherein the fluorescent lamp is a short version of the T-5 fluorescent lamp, having a length of 549 millimeters (21.614 inches).

4. A lampholder adapter as recited in claim 1, wherein the fluorescent lamp is a medium version of the T-5 fluorescent lamp, having a length of 849 millimeters (33.425 inches).

5. A lampholder adapter as recited in claim 1, wherein the fluorescent lamp is a long version of the T-5 fluorescent lamp, having a length of 1149 millimeters (45.236 inches).

6. A lampholder adapter as recited in claim 1, wherein the base assembly is a short base assembly having a length of 3 centimeters, a width of 2.5 centimeters, and a depth of 3.5 centimeters.

7. A lampholder adapter as recited in claim 1, wherein the base assembly is a long base assembly having a length of 3.5 centimeters, a width of 2.5 centimeters, and a depth of 3.5 centimeters.

8. A lampholder adapter as recited in claim 1, wherein the rotatable locking disk member is made of a non-conductive material.

9. A lampholder adapter as recited in claim 1, wherein the rotatable locking disk member is 1.5 centimeters in diameter.

10. A lampholder adapter system for converting a T-8 lamp fixture to receive a T-5 fluorescent lamp, comprising:

a first lampholder adapter and a second lampholder adapter, wherein each lampholder adapter comprises, a base assembly having a main body flexibly coupled to a base member and a brace member coupled to the base member behind the main body and spaced from the main body to provide a slot;

the main body portion having a first slot, and at least one conductive lead aligned with a circular aperture;

a rotatable locking disk member, having a second slot, the rotatable locking disk member seated in the circular aperture of the main body portion, the first slot in the main body portion aligns with the second slot to enable the end-prongs of a lamp to slide into the rotatable locking disk member such that when the rotatable locking disk member is rotated, the end-prongs of the lamp are locked in the rotatable locking disk member and the end-prongs make contact with the at least one conductive lead;

the base member having a non-spring loaded flexible slide on bracket for coupling each lampholder adapter to an end of a fixture;

the lamp fixture having a first and a second end, the first lampholder adapter coupled to the first end of the lamp fixture, the second lampholder adapter coupled to the second end of the lamp fixture;

wherein the main body portion of each adapter can be bent into the slot toward the brace member to compensate for a fluorescent length difference when re-lamping; and the brace member of each adapter is positioned to contact the lamp fixture to brace the base assembly against the lamp fixture when re-lamping.

11. A lampholder adapter system as recited in claim 10, wherein the first lampholder and the second lampholder adapters are a short lampholder adapters.

12. A lampholder adapter system as recited in claim 10, wherein the first lampholder adapter is a short lampholder adapter and the second lampholder adapter is a long lampholder adapter.

13. A lampholder adapter system as recited in claim 12, wherein the short lampholder adapter is 3 centimeters in length, 2.5 centimeters in width, and 3.5 centimeters in depth.

14. A lampholder adapter as recited in claim 12, wherein the long lampholder adapter is 3.5 centimeters in length, 2.5 centimeters in width, and 3.5 centimeters in depth.

15. A lampholder adapter system as recited in claim 14, wherein the short lampholder adapter is 3 centimeters in length, 2.5 centimeters in width, and 3.5 centimeters in depth.

16. A lampholder adapter system as recited in claim 10, wherein the first lampholder and the second lampholder adapters are a long lampholder adapters.

17. A lampholder adapter as recited in claim 16, wherein the long lampholder adapter is 3.5 centimeters in length, 2.5 centimeters in width, and 3.5 centimeters in depth.

18. A method of adapting a T-8 lamp fixture to accept a T-5 fluorescent lamp comprising the steps of:

replacing one of the lampholders for a T-8 lamp in a lamp fixture initially built for a T-8 lamp with a first lampholder having a main body flexibly coupled to a base member and a brace member coupled to the base member behind the main body and spaced from the main body; the main body having slots for receiving end prongs of a T-5 lamp;

positioning the first lampholder in the T-8 lamp fixture with the brace member contacting an end of the lamp fixture to brace the first lampholder;

replacing another of the lampholders for a T-8 lamp in the lamp fixture with a second lampholder having a main body flexibly coupled to a base member and a brace member coupled to the base member behind the main body and spaced from the main body; the main body having slots for receiving end prongs of a T-5 lamp; and positioning the second lampholder in the T-8 lamp fixture with the brace member contacting an end of the lamp fixture to brace the second lampholder;

wherein the main body of the first and second lampholders can bend toward the brace members to compensate for a lamp length difference when the lamp fixture is re-lamped with a T-5 lamp.

* * * * *